US010240877B2

(12) United States Patent
Powell

(10) Patent No.: US 10,240,877 B2
(45) Date of Patent: Mar. 26, 2019

(54) SPLASH BAR MODULE AND METHOD OF INSTALLATION

(71) Applicant: SPX COOLING TECHNOLOGIES, INC., Overland Park, KS (US)

(72) Inventor: Randall W. Powell, Louisburg, KS (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 77 days.

(21) Appl. No.: 14/540,465

(22) Filed: Nov. 13, 2014

(65) Prior Publication Data

US 2015/0130092 A1 May 14, 2015

Related U.S. Application Data

(63) Continuation-in-part of application No. 14/537,419, filed on Nov. 10, 2014, now abandoned.

(60) Provisional application No. 61/903,112, filed on Nov. 12, 2013.

(51) Int. Cl.
*F28F 25/08* (2006.01)

(52) U.S. Cl.
CPC ..... *F28F 25/082* (2013.01); *F28F 25/085* (2013.01); *Y10T 29/4935* (2015.01)

(58) Field of Classification Search
CPC .... F28F 25/082; F28F 25/085; Y10T 29/4935
See application file for complete search history.

(56) References Cited

U.S. PATENT DOCUMENTS

| | | | | | |
|---|---|---|---|---|---|
| 2,197,970 | A | * | 4/1940 | Elmer | F28F 25/082 261/111 |
| 2,306,047 | A | * | 12/1942 | Elmer | F28F 25/082 261/108 |
| 2,470,652 | A | | 5/1949 | Scofield | |
| 2,630,305 | A | | 3/1953 | Scofield et al. | |
| 2,809,818 | A | | 10/1957 | Munters | |
| 2,898,097 | A | * | 8/1959 | Goldsmith | F28C 1/04 261/108 |
| 3,063,688 | A | * | 11/1962 | Fordyce | F28F 25/082 182/194 |
| 3,201,077 | A | | 8/1965 | Heimann | |
| 3,363,885 | A | * | 1/1968 | Meek | F28C 1/04 261/111 |
| 3,702,709 | A | | 11/1972 | Shaffer | |

(Continued)

FOREIGN PATENT DOCUMENTS

| | | |
|---|---|---|
| DE | 1045432 | 12/1958 |
| DE | 2619923 | 11/1976 |

(Continued)

*Primary Examiner* — Stephen Hobson
(74) *Attorney, Agent, or Firm* — Baker & Hostetler LLP

(57) ABSTRACT

A fill in a rectilinear evaporative cooling tower includes a grid, grid support, module radial support, module column and module girts. The grid is to support a plurality of splash bars. The grid support is configured to provide support for the grid. The module support is configured to provide support for the grid support. The module column is configured to provide support for the module support. The module girts is configured to rest on a fill support frame of the rectilinear evaporative cooling tower and configured to provide support for the module columns.

16 Claims, 14 Drawing Sheets

(56) References Cited

U.S. PATENT DOCUMENTS 3,743,257 A * 7/1973 Fordyce ..... F28C 1/04 165/900
3,751,017 A 8/1973 Lemmens
3,764,121 A * 10/1973 Fordyce ..... F28C 1/04 261/111
3,768,416 A * 10/1973 Juechter ..... B65D 19/38 104/135
3,804,389 A * 4/1974 Engalitcheff, Jr. ..... F28C 1/02 261/111
3,870,773 A * 3/1975 Luzaich ..... E04H 5/12 261/111
4,000,228 A * 12/1976 Chevakin ..... F28C 1/00 261/111
4,022,593 A 5/1977 Lerner
4,052,491 A * 10/1977 Lefevre ..... F28F 25/087 261/112.2
4,115,484 A * 9/1978 Saxton ..... F28F 25/082 261/111
4,164,378 A 8/1979 Linehan
4,195,873 A 4/1980 Johnston
4,269,794 A 5/1981 Bosne et al.
4,269,795 A * 5/1981 Bosman ..... F28F 25/082 248/340
4,299,785 A * 11/1981 Fougea ..... E04H 5/12 261/111
4,374,786 A * 2/1983 McClain ..... B01J 19/32 261/113
4,422,983 A * 12/1983 Bardo ..... F28C 1/00 261/111
4,454,079 A * 6/1984 Hoffmann ..... F28F 25/082 261/111
4,514,202 A * 4/1985 Kinney, Jr. ..... F28C 1/16 261/DIG. 11
4,515,735 A * 5/1985 Phelps ..... F28F 25/082 261/111
4,591,462 A 5/1986 Peterson
4,781,869 A * 11/1988 Wiltz ..... F28C 1/02 261/111
4,890,400 A 1/1990 Long
4,913,710 A * 4/1990 Reverdv ..... F28C 1/02 261/DIG. 11
5,155,961 A * 10/1992 Bardo ..... F28C 1/00 261/111
5,286,130 A 2/1994 Mueller
5,487,849 A * 1/1996 Curtis ..... F28C 1/02 261/110
5,851,446 A * 12/1998 Bardo ..... E04H 5/12 261/111
5,902,522 A * 5/1999 Seawell ..... E04H 5/12 261/111
6,022,164 A 2/2000 Tsui et al.
6,032,993 A 3/2000 Kwon
6,517,058 B1 * 2/2003 Engh ..... F28F 25/087 261/112.1
6,634,592 B1 10/2003 Berousek
6,652,012 B1 11/2003 Fuller et al.
7,603,774 B2 * 10/2009 Facius ..... F28C 1/14 261/153
8,756,955 B2 6/2014 Walchle et al.
2004/0150122 A1 8/2004 Engh et al.
2006/0163757 A1 * 7/2006 Mockry ..... F28F 25/082 261/111
2007/0176308 A1 * 8/2007 Shepherd ..... F28F 25/082 261/111
2011/0036542 A1 2/2011 Woicke
2011/0078976 A1 * 4/2011 Abeln ..... B66C 1/16 52/745.02
2011/0278871 A1 11/2011 Haun et al.
2012/0319312 A1 12/2012 Mockry et al.
2013/0047356 A1 2/2013 Meurville et al.
2014/0262140 A1 9/2014 Powell et al.
2015/0014869 A1 * 1/2015 Roth ..... F28C 1/00 261/24
2015/0130094 A1 * 5/2015 Powell ..... F28F 25/085 261/160
2015/0211818 A1 * 7/2015 Krell ..... F28F 25/082 261/146

FOREIGN PATENT DOCUMENTS

DE 2945870 5/1981
JP 2007120919 5/2007
JP 4821269 11/2011
WO WO-03029743 A1 * 4/2003 ..... F28C 1/02

* cited by examiner

SPLASH BAR MODULE AND METHOD OF INSTALLATION

CROSS REFERENCE TO RELATED APPLICATIONS

This application is a Continuation-in-part application and claims priority to U.S. patent application Ser. No. 14/537,419, filed on Nov. 10, 2014, which claims priority to U.S. Provisional Application Ser. No. 61/903,112, filed on Nov. 12, 2013, titled "SPLASH BAR MODULE AND METHOD OF INSTALLATION," the disclosures of which are incorporated herein by reference in their entireties.

FIELD OF THE INVENTION

This invention relates generally to an improved heat exchange splash bar apparatus and method for installing fill module in evaporative water cooling towers or the like. More particularly, the present invention relates, for example, to a fill module and method to improve the process of installing fill modules in evaporative water cooling towers.

BACKGROUND OF THE INVENTION

Generally, evaporative water cooling towers include an upper hot water distribution system. Examples of upper hot water distribution system may have a series of water distribution nozzles or an apertured distribution basin or the like, and a cold water collection basin positioned at the base or bottom of the cooling tower. Commonly, a splash-type water dispersing fill structure is disposed in the space between the hot water distribution system and the underlying cold water collection basin. The aforementioned fill structure oftentimes includes either a plurality of elongated, horizontally arranged and staggered splash bars supported at spaced intervals by an upright grid structure or frame assembly, or a series of fill packs composed of a number of film fill sheets. During assembly of the evaporative cooling towers, typically, an outer shell or support structure is built first and then a rack or grid support is affixed to the support shell. Splash bars are then threaded into the rack.

The splash bars generally provide a surface for consistent, predictable dispersal and breakup of the water droplets over a range of water loadings typically encountered during operation of the evaporative cooling tower. Typically, these splash bars are long and thin and the fill structure includes a great number of them. Unfortunately, the same characteristics that make an efficient splash bar and fill assembly also make the fill assembly difficult, tedious, expensive, and time consuming to install.

Accordingly, there is a need in the art to improve the installation of a splash bar apparatus.

SUMMARY OF THE INVENTION

The foregoing needs are met, to a great extent, by the present invention, wherein aspects of a splash bar module and method of installation are provided.

An embodiment of the present invention pertains to a fill module for evaporative cooling. The fill module includes a plurality of splash bars, a grid to support the plurality of splash bars, and a module frame to support the grid and the plurality of splash bars. The fill module is configured to be installed in a rectilinear evaporative cooling structure as a unit.

Another embodiment of the present invention relates to a method for installing a fill module in a rectilinear cooling tower. In this method, the fill module is assembled with a grid and a plurality of splash bars. The fill module is configured to be installed in the rectilinear cooling tower as a unit.

Yet another embodiment of the present invention relates to a fill in a rectilinear evaporative cooling tower. The fill includes a grid, grid support, module support, module column and module girts. The grid is to support a plurality of splash bars. The grid support is configured to provide support for the grid. The module support is configured to provide support for the grid support. The module column is configured to provide support for the module support. The module girts is configured to rest on a fill support frame of the rectilinear evaporative cooling tower and configured to provide support for the module columns.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
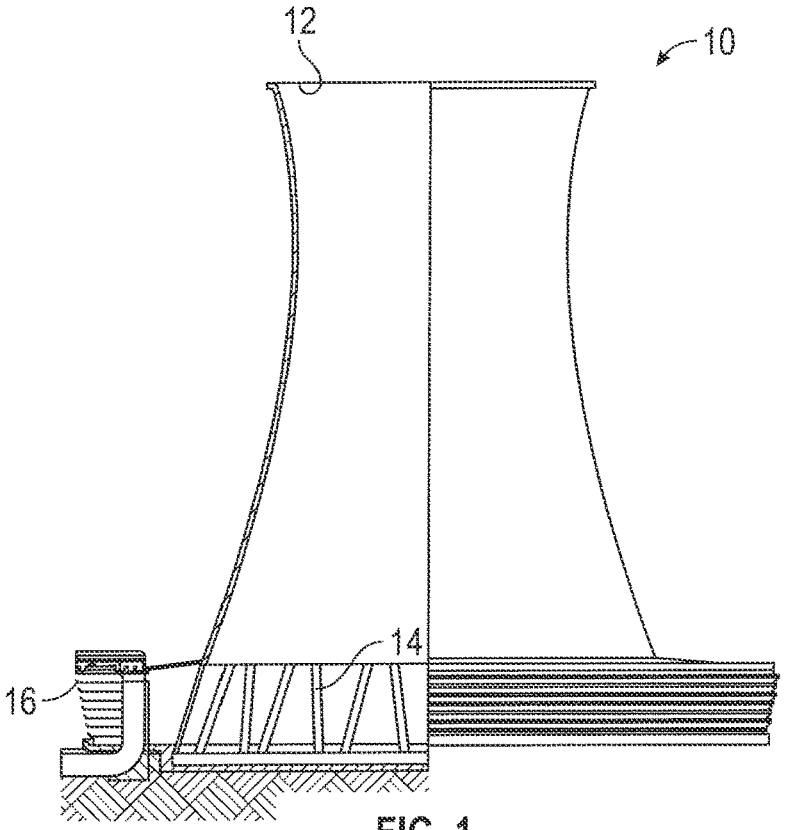
FIG. 1 is a partial cross sectional view of a cooling tower suitable for use with an embodiment of the present invention.

Various embodiments of the present invention provide for an improved fill assembly method of installing the improved fill assembly in the cooling tower. Preferred embodiments of the invention will now be further described with reference to the drawing figures, in which like reference numerals refer to like parts throughout.

Turning now to the drawings, FIG. 1 is a partial cross sectional view of a cooling tower 10 suitable for use with an embodiment of the present invention. As shown in FIG. 1, the cooling tower 10 includes a shell 12, support structure 14, and fill support frame 16. In general, the cooling tower 10 is configured to generate a natural draft of cooling air that is drawn in through the fill support frame 16 and up and out the shell 12.

Figure 2:
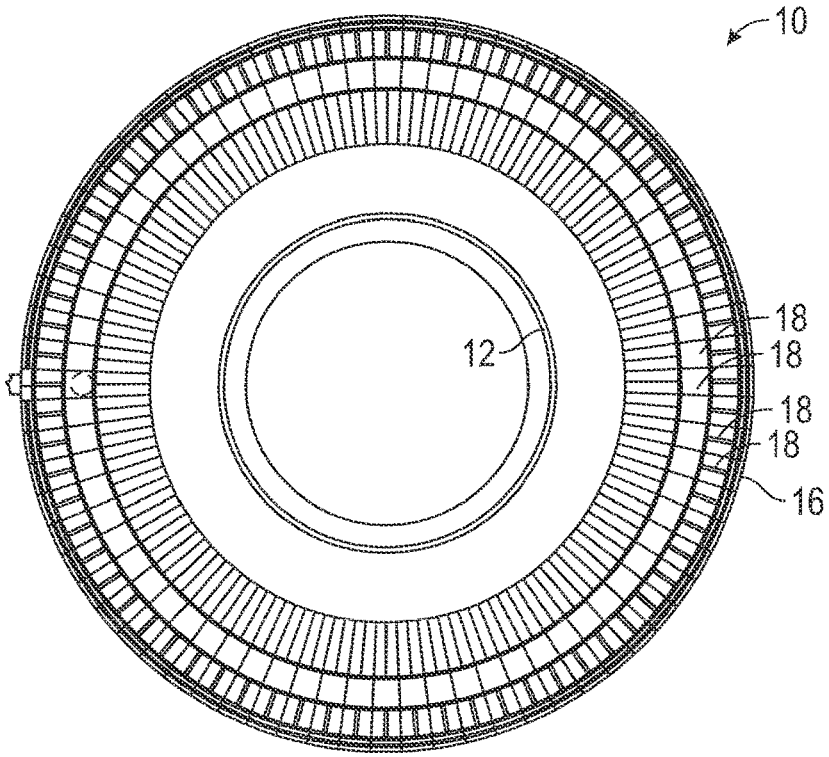
FIG. 2 is a cross sectional top view of the cooling tower depicted in FIG. 1.

FIG. 2 is a cross sectional top view of the cooling tower 10 depicted in FIG. 1. As shown in FIG. 2, the fill support frame 16 includes a plurality of radial framing members 18. As shown herein, the fill is disposed between the radial framing members 18.

Figure 3:
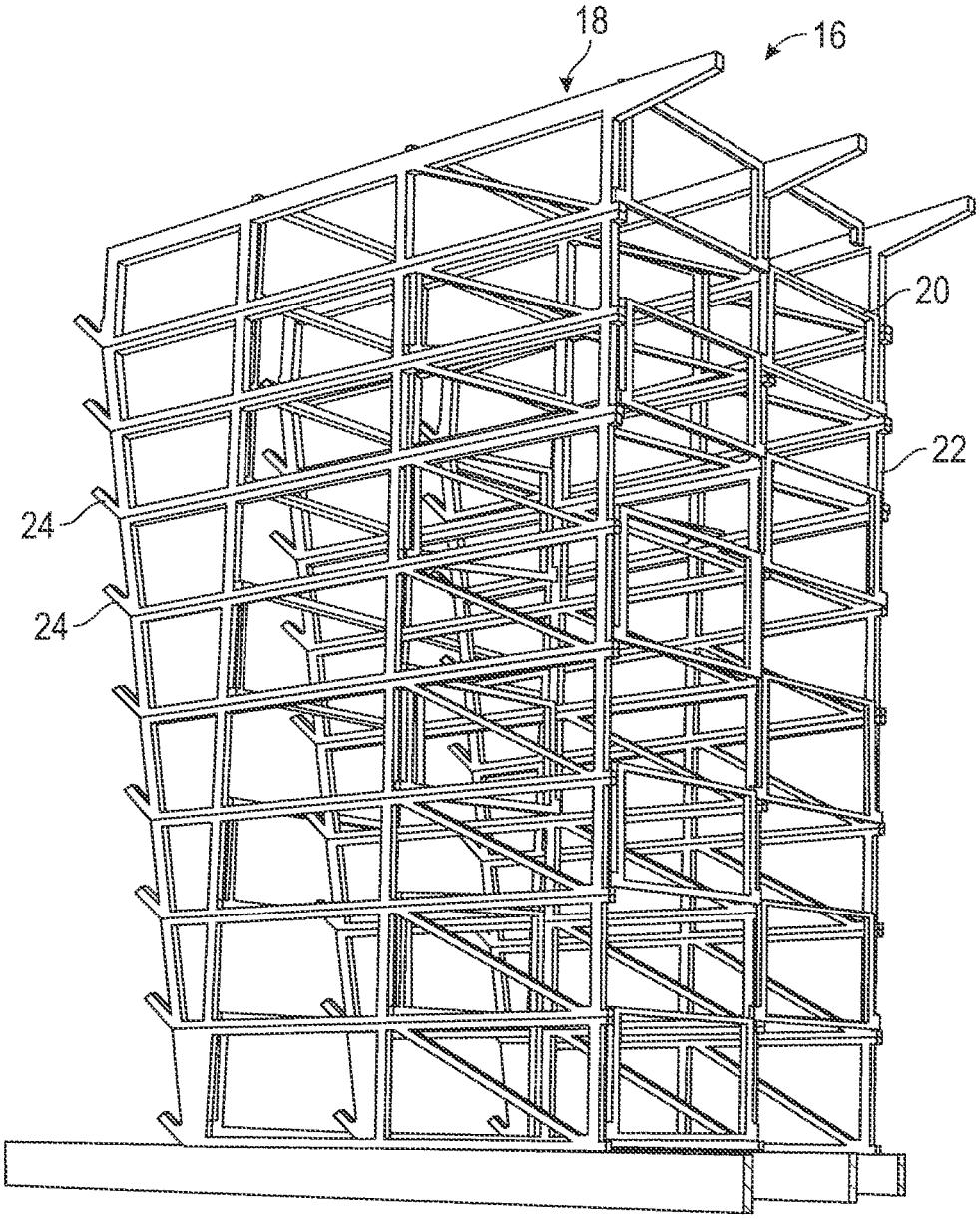
FIG. 3 is a perspective side view of a frame for a fill module according to an embodiment of the invention.

FIG. 3 is a perspective side view of the fill support frame 16 for a fill module according to an embodiment of the invention. As shown in FIG. 3, the fill support frame 16 includes the radial framing members 18, a plurality of circumferential framing members 20, column framing members 22, and louver support members 24. In general, these framing members may be made from any suitable material. An example of a suitable material includes steel reinforced concrete. This material is suitable due to its ability to withstand extremely humid environments.

Figure 4:
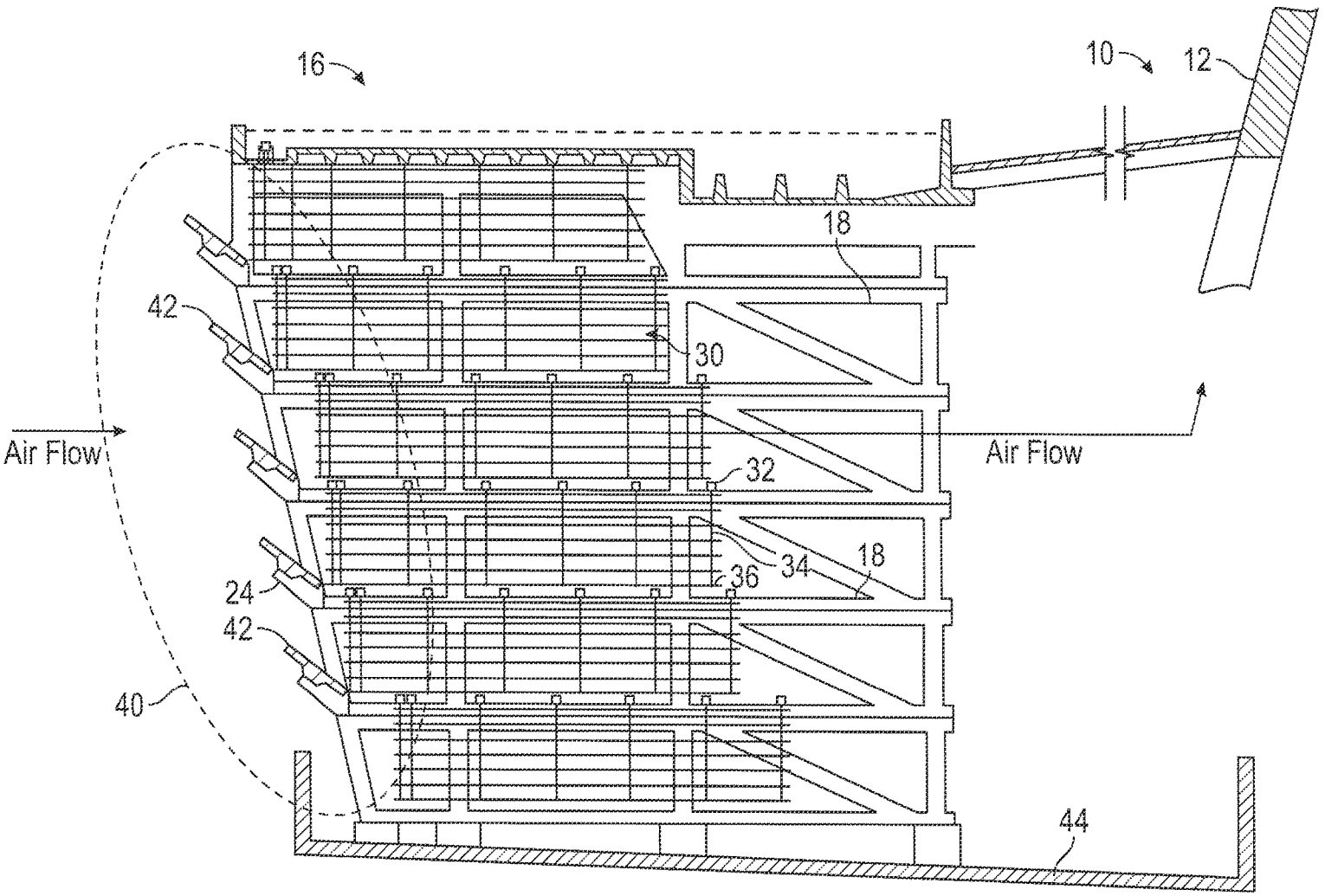
FIG. 4 is a side view of a conventional fill installation in a frame of a cooling tower.

FIG. 4 is a side view of a conventional fill installation in a frame of a cooling tower 10. As shown in FIG. 4, a conventional fill 30 includes fill support beams 32, fill support grids 34, and fill bars 36. This conventional fill 30 is installed in-place so that the fill support grids 34 can be hung from the fill support beams 32. Thereafter, the fill bars 36 are individually installed in the fill support grids. Of note, these structures are extremely tall and the work to install the conventional fill 30 is meticulous and time consuming. Due to the height, the work requires time consuming safety practices.

The conventional fill 30 is periodically changed to replace damaged fill bars 36. One source of damage is due to ice at an air inlet area 40. In operation, water is deposited at the top of the fill support frame 16 to cascade down through the conventional fill 30. Heat is removed from the water via air entering the air inlet area 40. A plurality of louvers 42 help direct water back into the fill support frame 16. The cooled water collects in a catch basin 44 and this water may be returned to a heat generating facility such as a power plant or the like (not shown). Cold air entering the fill support frame 16 may freeze the water nearest the air inlet area 40. Icicles or other large formations of ice may form and then break and fall on the fill bars 36 causing damage.

Figure 5:
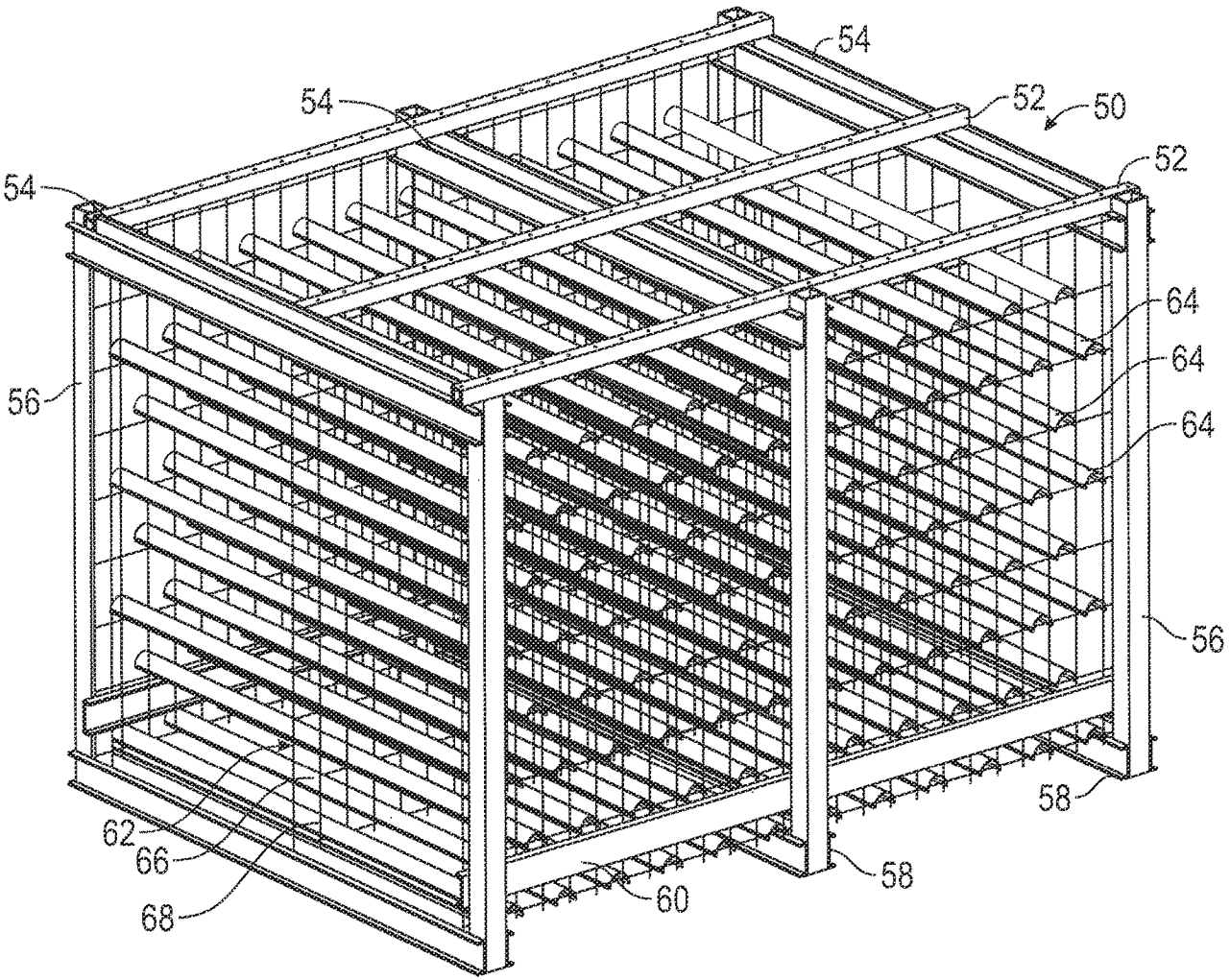
FIG. 5 is a perspective view of the fill module according to an embodiment of the invention.

FIG. 5 is a perspective view of a fill module 50 according to an embodiment of the invention. As shown in FIG. 5, the fill module 50 includes a plurality of grid supports 52, module radial supports 54, module columns 56, module radial girts 58, module circumferential girts 60, grids 62, and splash fill bars 64. The grid supports 52 are configured to provide support for the grids 62 to hang from. The module radial supports 54 are configured to provide support for the grid supports 52. The module columns 56 are configured to provide support for the module radial supports 54. The module radial girts 58 are configured to rest on the fill support beams 32 and provide support for the module columns 56. For example, the module radial girts 58 are configured to rest on the fill support beams 32, and/or the like. The module circumferential girts 60 are configured to help strengthen the fill module 50.

The grids 62 are configured to retain the splash fill bars 64. In a particular example, the grids 62 include horizontal members 66 and vertical members 68 that cross each other to for a grid-like pattern. Individual splash fill bars 64 are disposed in the openings formed by the horizontal members 66 and vertical members 68.

In a particular example, the fill module 50 is preassembled and can be quickly installed in the fill support frame 16 or other such crossflow cooling tower. Embodiments of the fill module 50 save labor costs by allowing the fill module to be assembled at ground level and/or in a manufacturing facility rather than taking place at a height that is typically less efficient. This has the advantage on fill replacement jobs of shortening the elapsed construction time and may greatly reduce down-time of a power plant. Thus, power plant outages may be shorter to accomplish restoration of cooling capacity which can result in economic benefit to the power producer.

The grid supports 52, module radial supports 54, module columns 56, module radial girts 58, module circumferential girts 60, and splash fill bars 64 may be made from any suitable material. Examples of suitable materials include fiber reinforced plastics (FRP), stainless steel or galvanized steel. The grids 62 may be made from any suitable material such as polypropylene, FRP, stainless steel, galvanized steel, polyvinyl chloride (PVC) coated steel, or another such corrosion resistant construction material. The splash fill bars 64 may be made from any suitable material such as FRP, PVC, rust resistant or coated metal, and the like. The fill modules 50 may be preassembled off site and transported to the cooling tower 10 site or they may be assembled on site at grade near the cooling tower 10.

Figure 6:
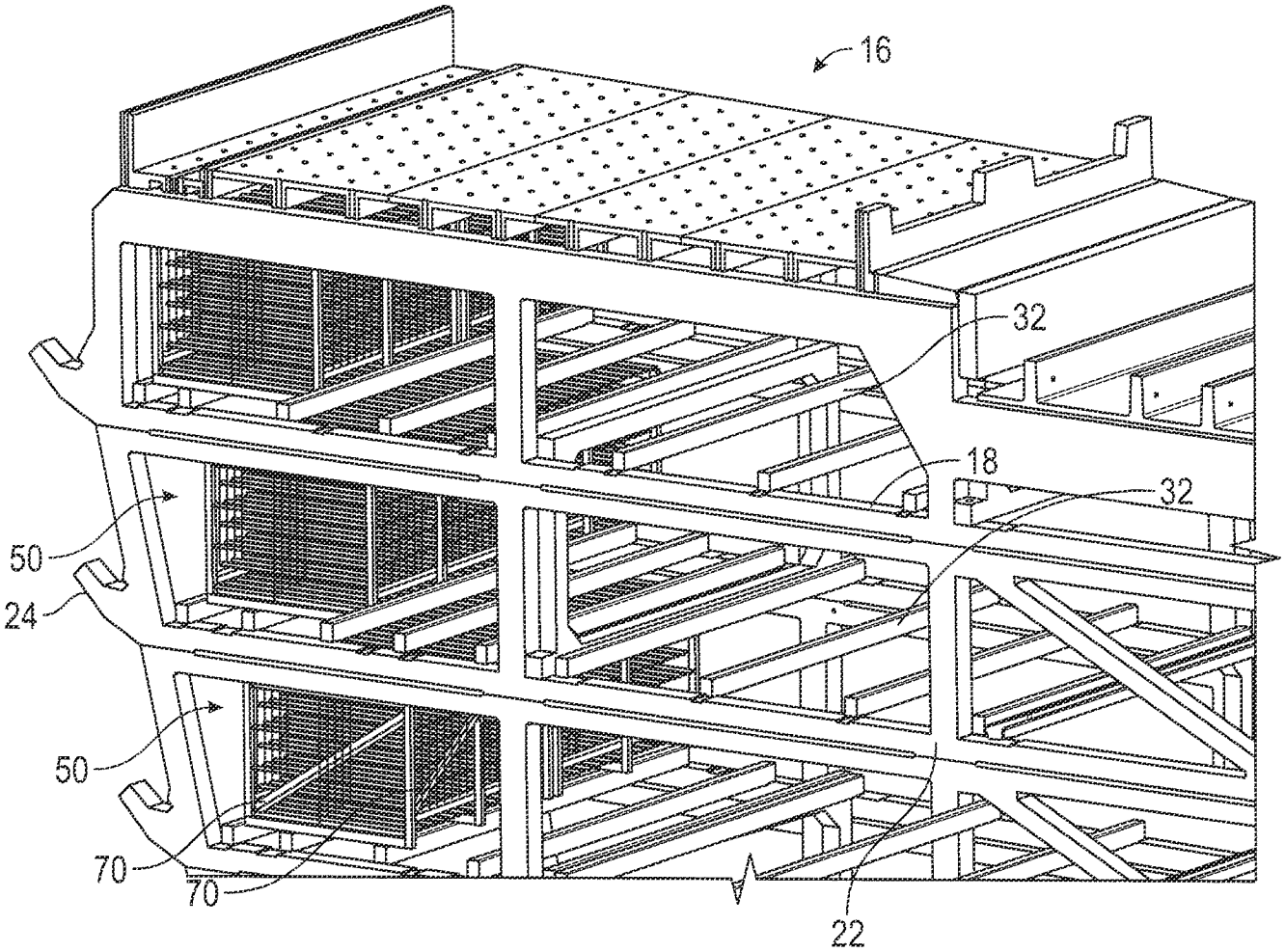
FIG. 6 is a perspective view of the fill module installed in the frame according to an embodiment of the invention.

FIG. 6 is a perspective view of the fill module 50 installed in the fill support frame 16 according to an embodiment of the invention. As shown in FIG. 6, the fill module 50 may be disposed upon the fill support beams 32 of the fill support frame 16. In a particular example, the louvers 42 (shown in FIG. 4) have been removed to allow the fill modules 50 to be lifted an inserted with a fork lift, crane, hoist, or the like. In this manner, the fill module 50 having a height that is about equal (slightly less) than the distance between the fill support beams 32 of one layer to the next of the fill support frame 16 may be inserted directly into the fill support frame 16. Also shown in FIG. 6, the fill module 50 optionally includes one or more diagonal bracing 70.

Figure 7:
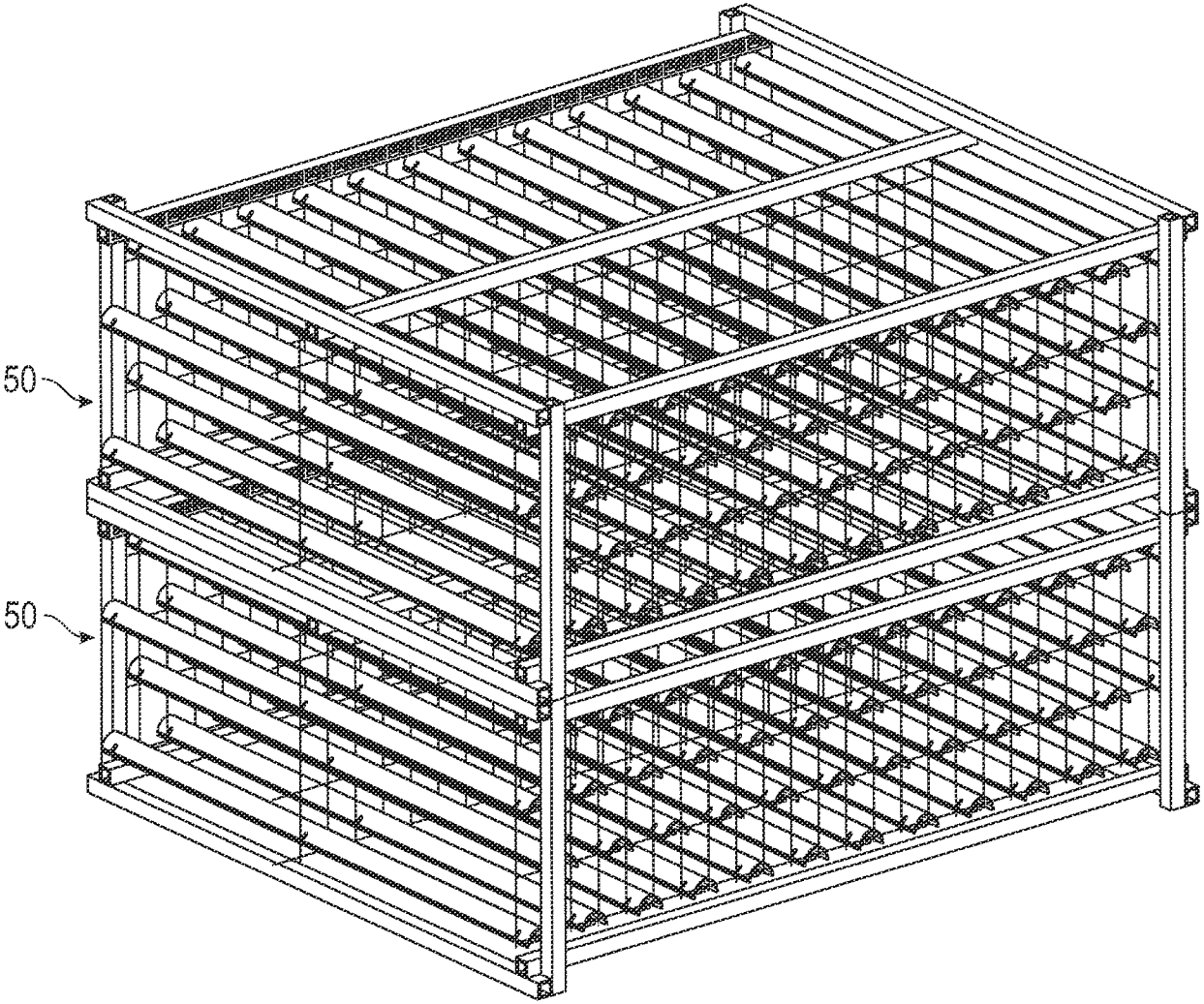
FIG. 7 is a perspective view of the fill module according to another embodiment of the invention.

FIG. 7 is a perspective view of the fill module 50 according to another embodiment of the invention. As shown in FIG. 7, the fill module 50 of this embodiment is configured to be stacked, one upon the other, to generate the height that is about equal (slightly less) than the distance between the fill support beams 32 of one layer to the next (See FIG. 8). That is, in this embodiment, two smaller height fill modules 50 are stacked and their combined heights are the same height as the single full height fill module 50. These smaller height fill modules 50 are sufficiently short enough to pass between the louvers 42.

Figure 8:
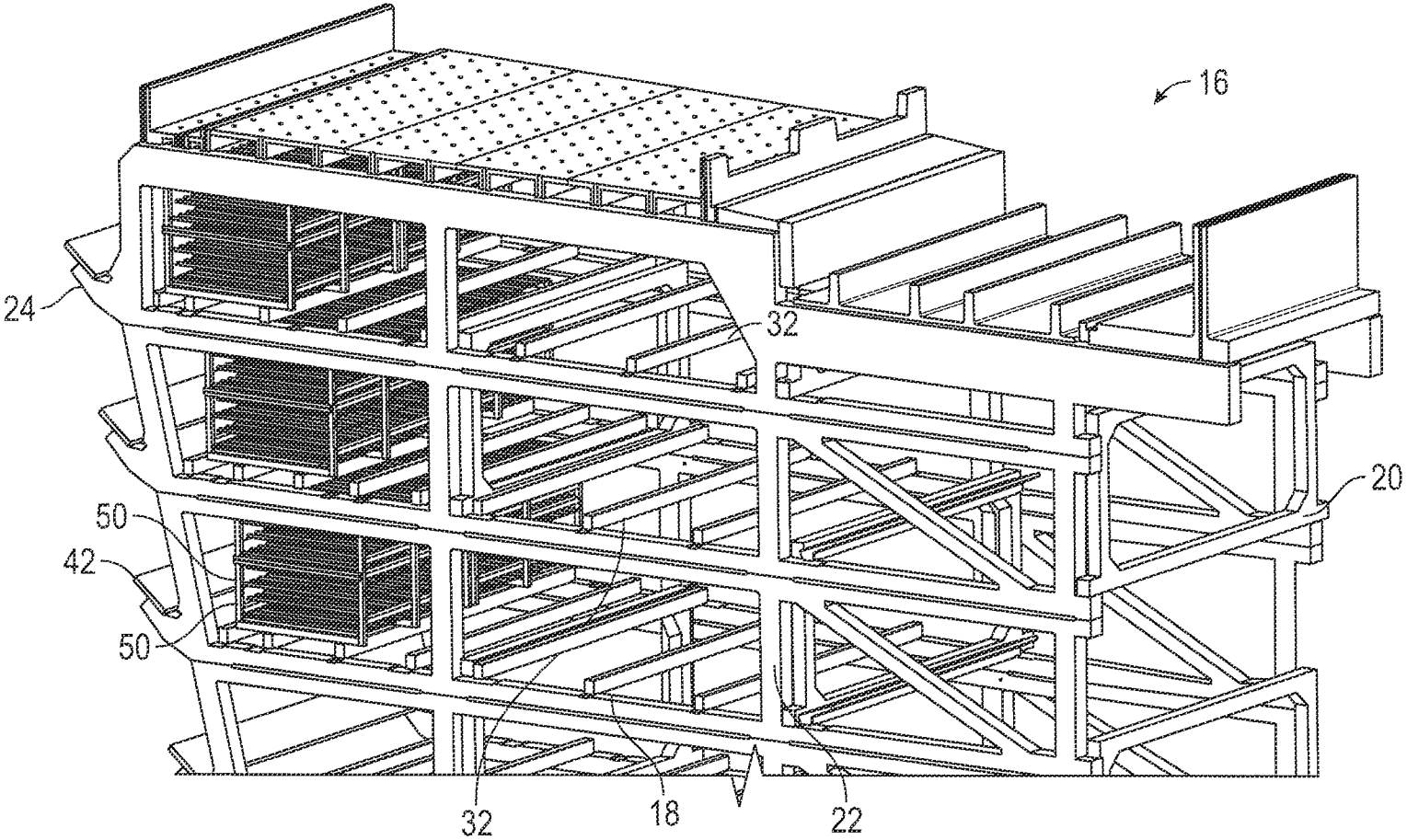
FIG. 8 is a perspective view of the fill module installed in the frame according to an embodiment of the invention.

FIG. 8 is a perspective view of the fill module 50 installed in the fill support frame 16 according to an embodiment of the invention. As shown in FIG. 8, the fill modules 50 are configured to be installed in the support frame 16 without removal of the louvers 42. As described further herein, a first half-height fill module 50 may be tilted into the opening above the louver 42 and then placed on the fill support beams 32 and then a second half-height fill module 50 may be inserted into the opening and disposed on top of the first half-height fill module 50. It is to be understood is that the modules may not be exactly half-height as the total number of bar layers may be odd and not evenly divisible.

Figure 9:
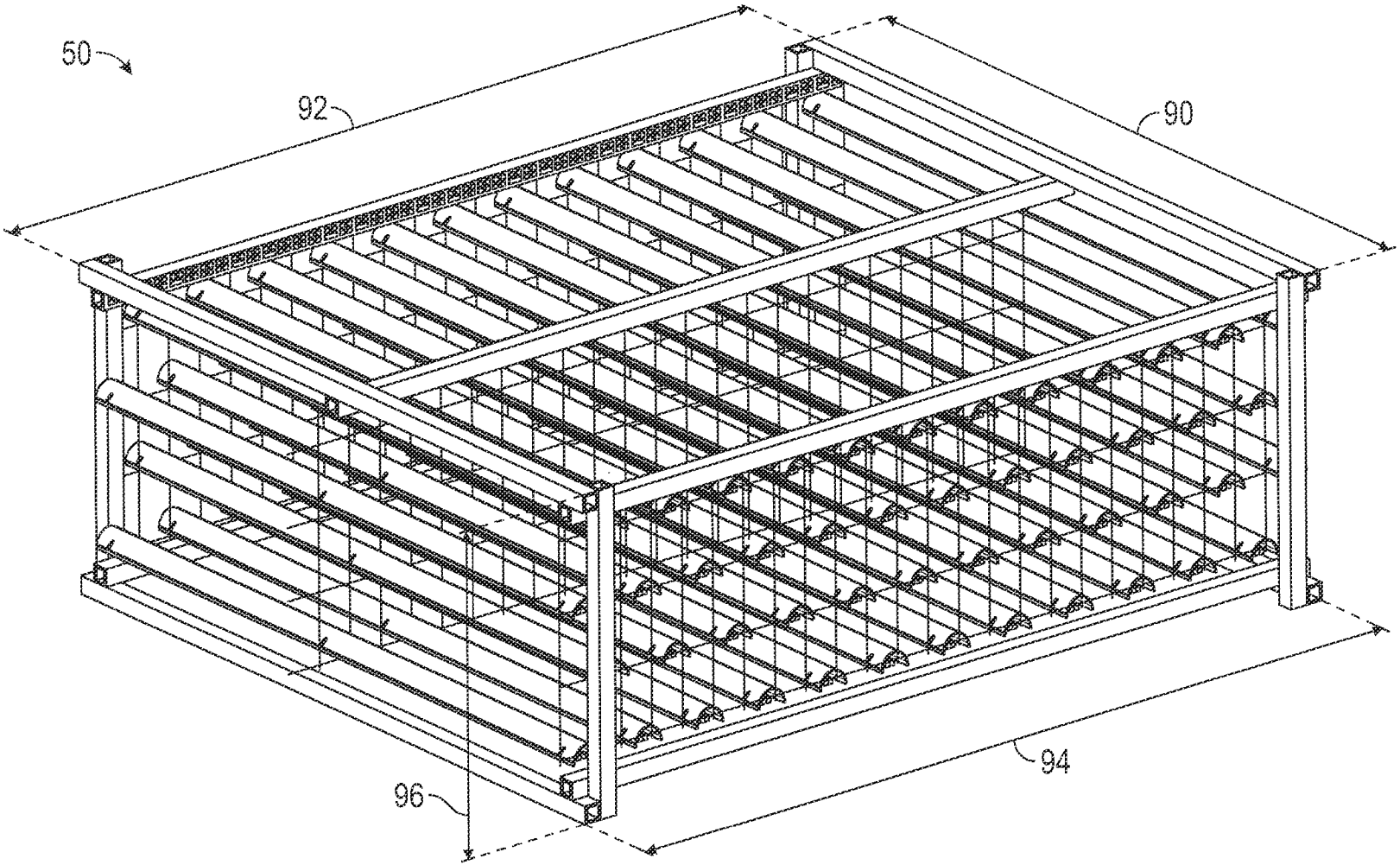
FIG. 9 is a perspective view of a fill sub-module according to the embodiment of FIG. 7.

FIG. 9 is a perspective view of the half-height fill module 50 or a fill sub-module 50 according to the embodiment of FIG. 7. In a particular installation in an annular fill support frame 16 that circles the cooling tower 10 and wherein the radius of the fill support frame 16 changes from one level to the next because of the sloping louver face of the fill support frame 16, dimensions of the fill module 50 may vary accordingly. For example, the radial dimensions change from level to level. Furthermore, as the radial dimensions change so do the circumferential dimensions. As shown in FIG. 9, the fill sub-module 50 includes a radial length 90, an outboard circumferential width 92, an inboard circumferential width 94, and a height 96. In a specific example, the radial length 90 is roughly 6 feet, the outboard circumferential width 92 is roughly 6 feet 3 inches, the inboard circumferential width 94 is slightly less than the outboard circumferential width 92, and the height 96 is about 3 feet. A nominal weight of the fill sub-module 50 is roughly 150 lbs.

Figure 10:
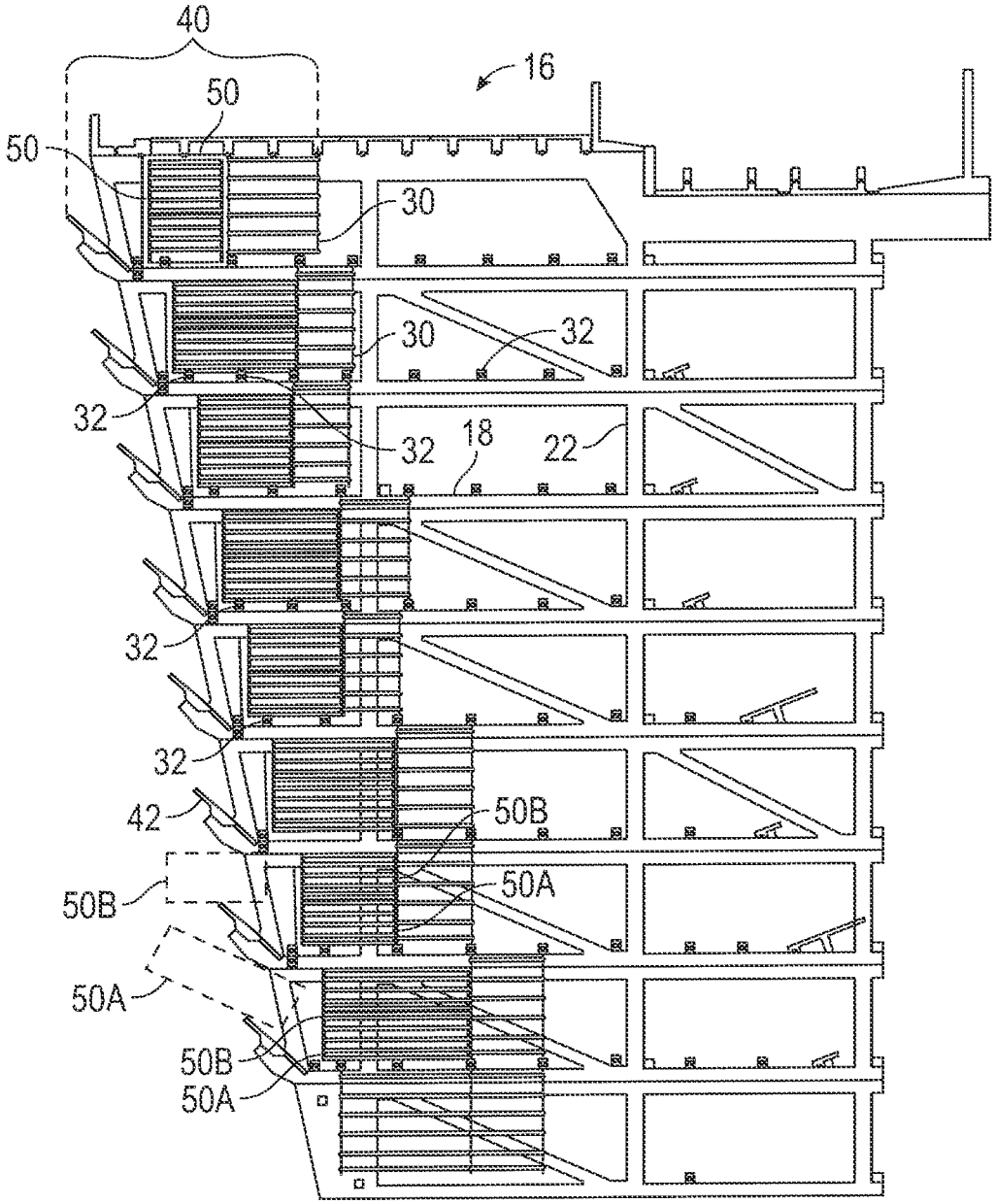
FIG. 10 is a side view of the fill installation in the frame of the cooling tower.

FIG. 10 is a side view of the fill module 50 installation in the fill support frame 16. As shown in FIG. 10, the fill modules 50 may co-exist with the conventional fill 30. This hybrid system may be particularly suitable in situations in which an existing fill support frame 16 is filled with conventional fill 30 and where the conventional fill 30 in the air inlet area 40 has been damaged while the remainder of the conventional fill 30 is undamaged. The damaged conventional fill 30 may be replaced by the fill modules 50 at a great savings in time and/or expense. This hybrid system may also be useful in some new installations in which it is anticipated that fill near the air inlet area 40 will be damaged but inboard fill would not be. In order to reduce time/expense in replacing the fill near the air inlet area 40, the fill module 50 may be used and in order to reduce materials, conventional fill 30 may be used in the remainder of the installation.

Also shown in FIG. 10, the fill module 50A may be installed without removal of the louvers 42 by lifting and tilting the fill module 50A into the opening between the louvers 42. Alternatively, the fill module 50A may be inserted into the opening in a level or horizontal manner and then a hoist may be used to support the fill module 50A while the forks are withdrawn. Thereafter, the hoist or other such device may lower the fill module 50A down onto the fill support beams 32. Thereafter, the fill module 50A may be disposed upon the fill support beams 32. The fill module 50B may be lifted and placed upon the fill module 50A.

Figure 11:
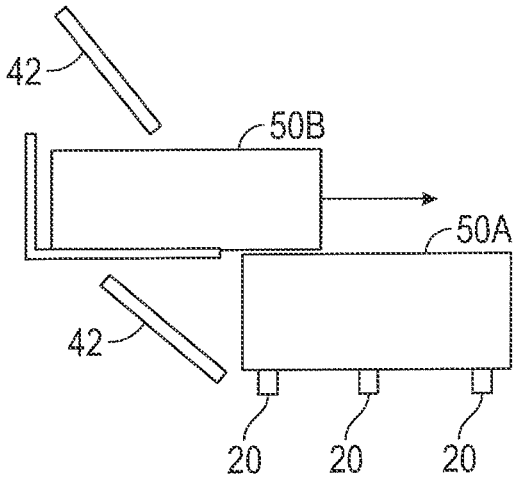
FIG. 11 is a side view showing a method of stacking the fill sub-modules in the frame according to an embodiment.

FIG. 11 is a side view showing a method of stacking the fill sub-modules 50 in the fill support frame 16 according to an embodiment. As shown in FIG. 11, the fill module 50B may be lifted, by a fork lift for example, and then inserted between the louvers 42 and on top of the fill module 50A. Of note, depending on the spacing between the louvers 42, three or more of the fill sub-modules 50 may be utilized to generate a full-height fill module 50.

Figure 12:
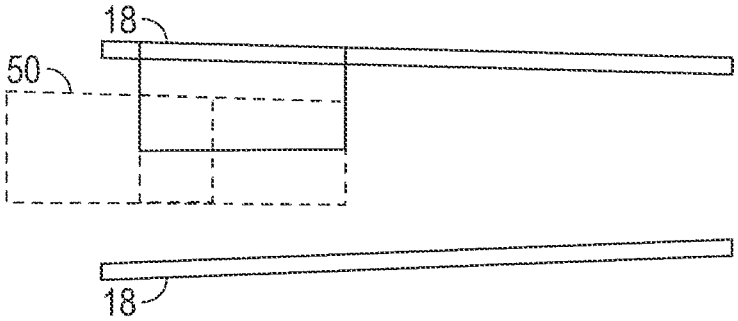
FIG. 12 is a top view showing a method of installing the fill modules in the frame according to an embodiment.
Figure 13:
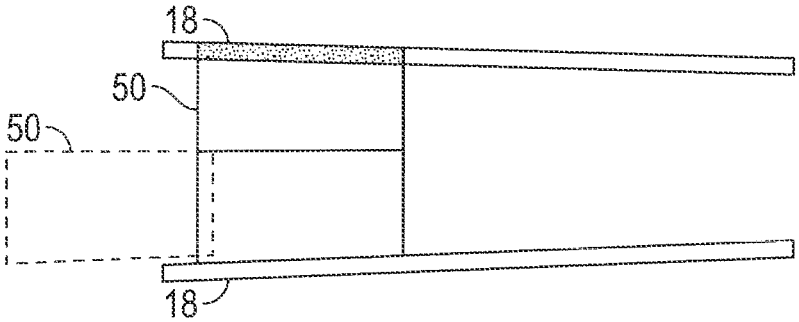
FIG. 13 is a top view showing a method of installing the fill modules in the frame according to an embodiment.

FIG. 12 is a top view showing a method of installing the fill modules 50 in the fill support frame 16 according to an embodiment. As shown in FIGS. 12 and 13, a pair of the fill modules 50 may be placed side by side between two adjacent radial framing members 18. In FIG. 12, the first fill module 50 is shown being inserted in at step 1, over at step 2, and resting in place at step 3. In FIG. 13, a second fill module 50 is shown being inserted between the first fill module 50 and the radial framing member 18.

It is a feature of this and other embodiments that the fill modules 50 may be slid under the radial framing members 18. In other words the fill modules 50 occupy the voids at the radial framing members 18 that typically occur in conventional fill installations. However, in some instances diagonals may be present in some of the frame windows and the splash fill may be left out of these regions if permitted by the thermal design. In the FIGS. 12 and 13, no diagonals are present in the outboard windows.

Figure 14:
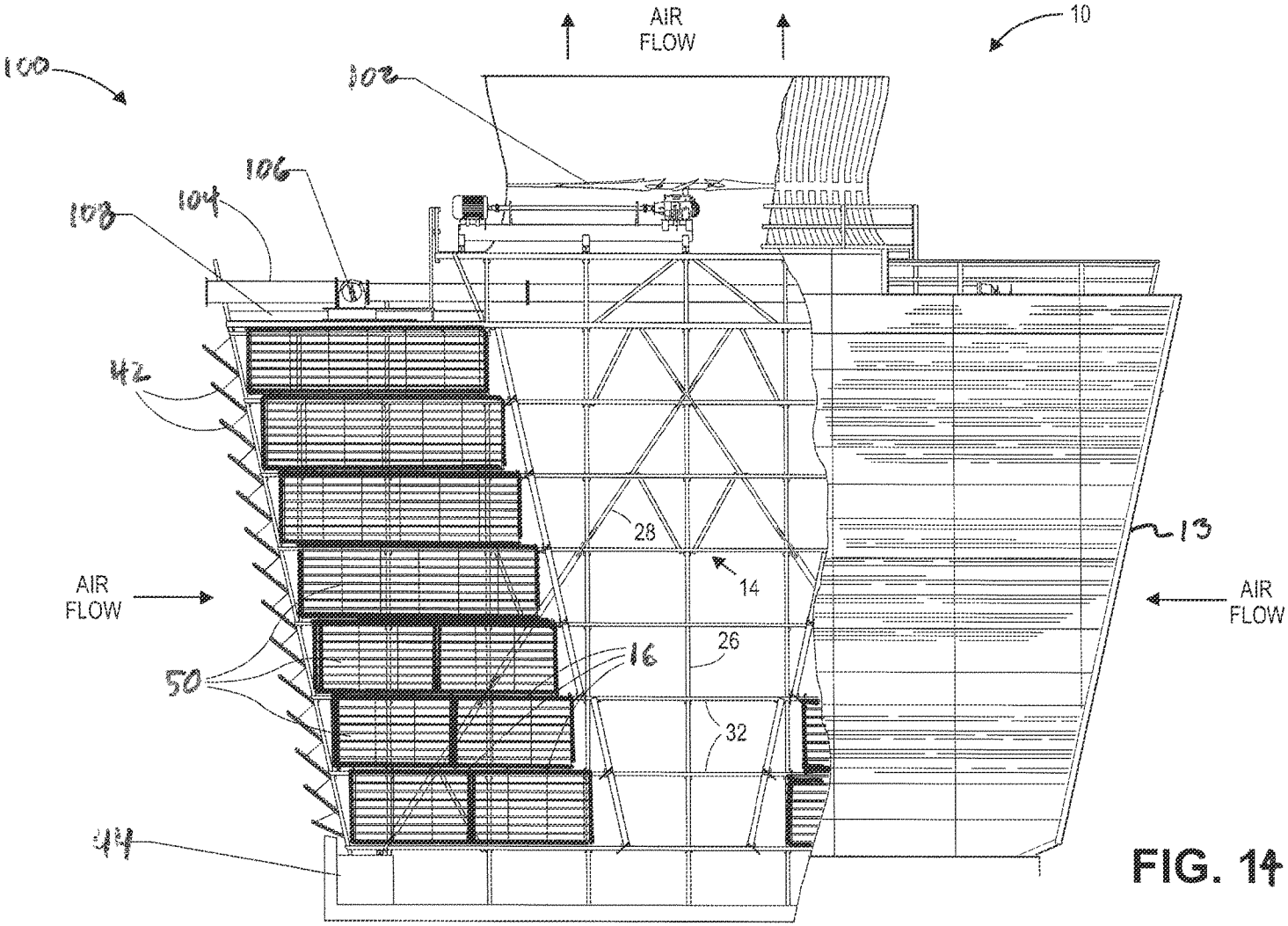
FIG. 14 is a partial cross sectional view of the cooling tower suitable for use with a rectilinear tower embodiment of the present invention.

FIG. 14 is a partial cross sectional view of the cooling tower 10 suitable for use with a rectilinear tower embodiment of the present invention. As shown in FIG. 14, the cooling tower 10 includes a casing 13, support structure 14, fill modules 50, a water supply assembly 100, catch basin 44, and a fan 102. The casing 13 is configured to control a flow of air across the fill modules 50. In this regard, ends of the cooling tower 10 may be configured to reduce air infiltration while the sides may include the louvers 42 to allow the flow of air to enter the cooling tower 10 and flow across the fill modules 50. In addition, the louvers 42 may be configured to redirect splashing water back into the cooling tower 10. The support structure 14 includes the fill support frame 16, columns 26, diagonal members 28, and fill support beams 32.

The water supply assembly 100 includes a water supply line 104, flow control valves 106, and a distribution basin 108. The water supply line 104 is configured to convey water and/or other coolant from a suitable heat source to the distribution basin. Suitable heat sources include, for example, a power plant, refrigeration unit, or the like. The flow control valve 106 is configured to modulate the flow of water from the water supply line 104 to the distribution basin 108. The distribution basin 108 is configured to provide a substantially evenly distributed flow of the water across the top of the fill modules 50. The fill modules 50 are configured to further distribute or otherwise increase the surface area of water interacting with the flow of air supplied by the fan 102. In this manner, waste heat is removed from the water. Thereafter, the cooled water is collected in the catch basin 44.

As shown in FIG. 14, the fill modules 50 may be full or partial depth. For example, if the fill modules 50 are going to be slid into position from within the cooling tower 10, it may be cramped—particularly at or near the bottom. In these situations or for other reasons, it may be beneficial that the fill modules 50 are less than the full length of the fill portion of the cooling tower 10. In addition, as already described herein, the fill modules 50 may be full height or partial height.

Figure 15:
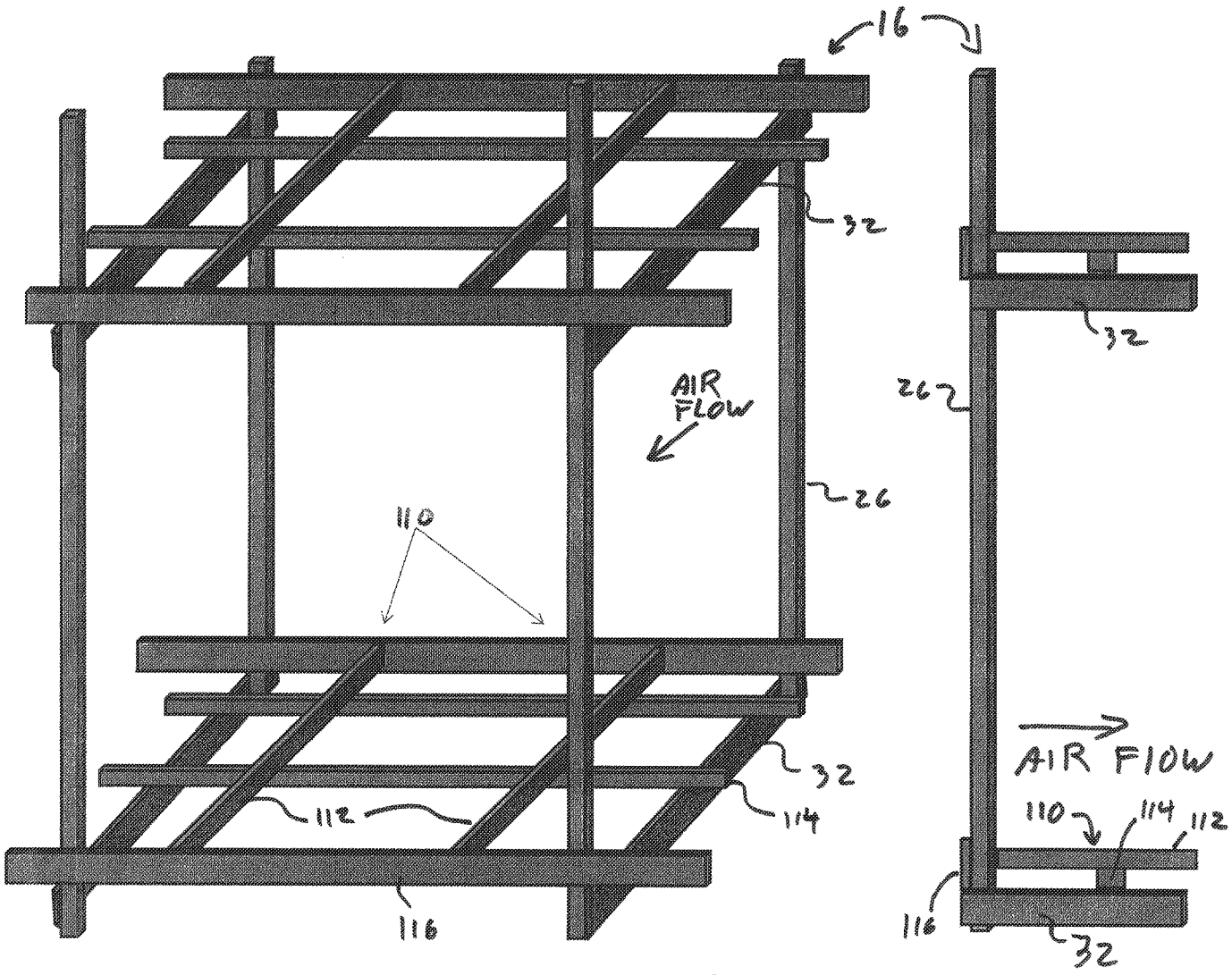
FIG. 15 is an orthogonal projection and side view of the fill support frame according to an embodiment.

FIG. 15 is an orthogonal projection and side view of the fill support frame 16 according to an embodiment. As shown in FIG. 15, the fill support frame 16 includes a sliding assembly 110 to facilitate sliding the fill module 50 into the fill support frame 16. In this embodiment, the sliding assembly 110 includes transverse members 112 resting on existing girts 114 and longitudinal members 116 securing the ends of the transverse members 112.

Figure 16:
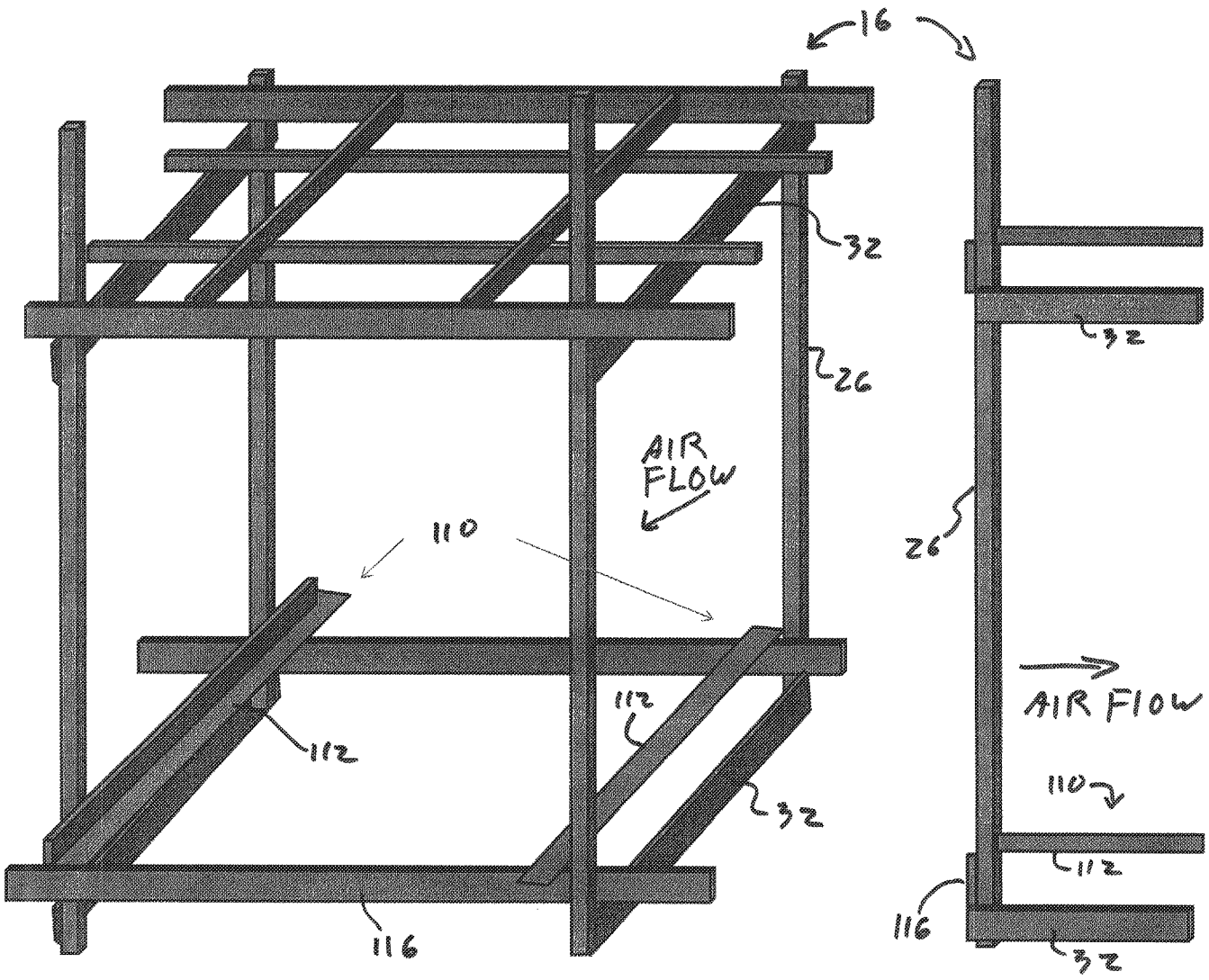
FIG. 16 is an orthogonal projection and side view of the fill support frame according to another embodiment.

FIG. 16 is an orthogonal projection and side view of the fill support frame 16 according to another embodiment. As shown in FIG. 16, the sliding assembly 110 includes the transverse members 112 resting on existing longitudinal members 116. In this embodiment, one or both of the transverse members 112 may be angled in a similar manner to structural angles in order to facilitate guiding the fill module 50 into the space between the columns 26.

Figure 17:
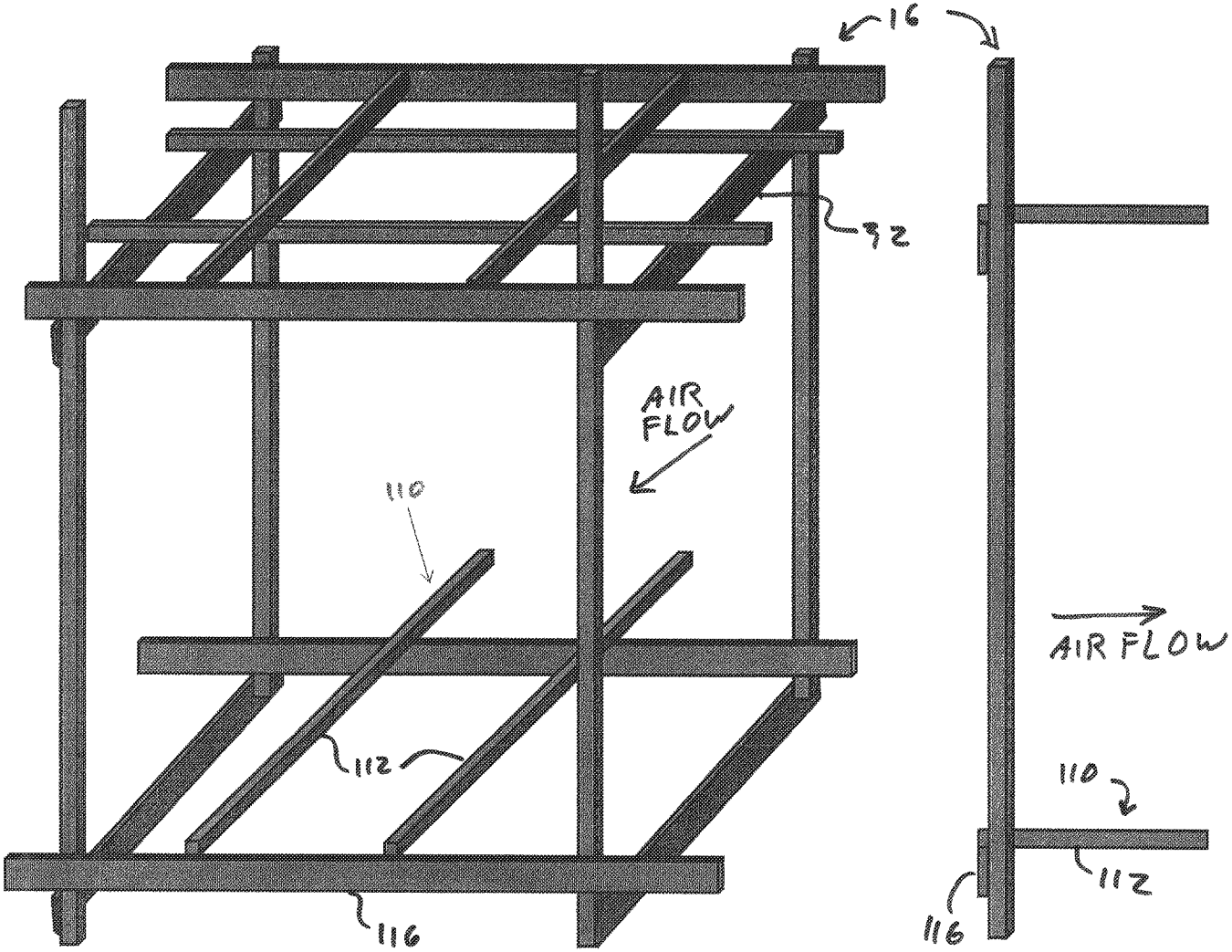
FIG. 17 is an orthogonal projection and side view of the fill support frame according to yet another embodiment.

FIG. 17 is an orthogonal projection and side view of the fill support frame 16 according to yet another embodiment. As shown in FIG. 17, the sliding assembly 110 includes the transverse members 112 resting on existing longitudinal members 116. In this embodiment, the transverse members 112 may be relatively small elements that are attached or resting on the longitudinal members 116.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A fill module in a rectilinear evaporative cooling tower stationed at a cooling tower site, the fill module comprising:

a first fill module including:

a grid to support a plurality of splash fill bars;

a grid support configured to provide support for the grid;

a module support configured to provide support for the grid support;

a module column configured to provide support for the module support; and a plurality of module girts configured to rest on a fill support frame of the rectilinear evaporative cooling tower and configured to provide support for the module columns, wherein said first fill module is assembled remotely from the cooling tower site and is transported to the cooling tower site for installation; and a second fill module, wherein the first fill module and the second fill module are each a respective height being equal to or less than a distance between a respective pair of consecutive support beams of the rectilinear evaporative cooling tower and the first fill module and the second fill module are disposed offset relative to one another in the rectilinear evaporative cooling tower, wherein said second fill module is assembled remotely from the cooling tower site and is transported to the cooling tower site for installation, wherein both the first fill module and the second fill module are each inserted between a respective pair of consecutive columns of the rectilinear evaporative cooling tower and both the first fill module and the second fill module are each inserted between the respective pair of consecutive support beams of the rectilinear evaporative cooling tower.

2. The fill module according to claim 1, further comprising:

a first pair of stacked fill modules including the first fill module and the second fill module disposed upon the first fill module; and a second pair of stacked fill modules including a third fill module and a fourth fill module disposed upon the third fill module, the first pair of stacked fill module modules being configured to be disposed into the fill support frame and the second pair of stacked fill module modules being configured to be disposed into the fill support frame behind the first pair of stacked fill module modules, wherein a combined length of the first pair of stacked fill module modules and the second pair of stacked fill module modules is about equal to a length of a fill opening in the fill support frame.

3. The fill module according to claim 1, further comprising:

a sliding assembly configured to facilitate sliding the fill module into the fill support frame, the sliding assembly including transverse members disposed upon the fill support frame.

4. The fill module according to claim 3, wherein the sliding assembly further comprises:

a longitudinal member to secure an end of the transverse members.

5. The fill module according to claim 1, further comprising a diagonal bracing disposed across the fill module from one corner of the module column to another corner of another module column.

6. A rectilinear evaporative cooling tower comprising: a tower shell;

a water supply assembly; and a fill module for evaporative cooling, the fill module being disposed in a fill support frame disposed annularly about the tower shell, the water supply assembly being configured to provide a supply of water to the fill module and the tower shell being configured to generate a flow of air across the fill module, the fill module including:

a first fill module including:

a grid to support a plurality of splash fill bars;

a grid support configured to provide support for the grid;

a module support configured to provide support for the grid support;

a module column configured to provide support for the module support; and a plurality of module girts configured to rest on a fill support frame of the rectilinear evaporative cooling tower and configured to provide support for the module columns; and a second fill module, wherein the first fill module and the second fill module are each a respective height being equal to or less than a distance between a respective pair of consecutive support beams of the rectilinear evaporative cooling tower and the first fill module and the second fill module are disposed offset relative to one another in the rectilinear evaporative cooling tower, wherein both the first fill module and the second fill module are each inserted between a respective pair of consecutive columns of the rectilinear evaporative cooling tower and both the first fill module and the second fill module are each inserted between the respective pair of consecutive support beams of the rectilinear evaporative cooling tower.

7. The rectilinear evaporative cooling tower according to claim 6, further comprising:

a first pair of stacked fill modules including the first fill module and the second fill module disposed upon the first fill module; and a second pair of stacked fill modules including a third fill module and a fourth fill module disposed upon the third fill module, the first pair of stacked fill module modules being configured to be disposed into the fill support frame and the second pair of stacked fill module modules being configured to be disposed into the fill support frame behind the first pair of stacked fill module modules, wherein a combined length of the first pair of stacked fill module modules and the second pair of stacked fill module modules is about equal to a length of a fill opening in the fill support frame.

8. The rectilinear evaporative cooling tower according to claim 6, further comprising a diagonal bracing disposed across the fill from one corner of the module column to another corner of another module column.

9. The rectilinear evaporative cooling tower according to claim 6, further comprising:

a sliding assembly configured to facilitate sliding the fill module into the fill support frame, the sliding assembly including transverse members disposed upon the fill support frame.

10. The rectilinear evaporative cooling tower according to claim 9, wherein the sliding assembly further comprises:

a longitudinal member to secure an end of the transverse members.

11. A method for installing a fill in a rectilinear cooling tower, the method comprising the steps of:

assembling a fill module of claim 9;

lifting the fill module; and disposing the fill module on a plurality of framing members.

12. The method according to claim 11, further comprising the step of:

disposing the fill module over a louver of the fill frame support and inserting the fill module into the fill frame support without removal of the louver.

13. The method according to claim 11, further comprising the steps of:

disposing a first fill module of the fill modules into the fill frame support to rest upon the fill frame support; and disposing a second fill module of the fill modules into the fill frame support to rest upon the first fill module.

14. The method according to claim 13, further comprising the step of:

sliding the first and second fill modules to one side to at least partially overlap a radial framing member of the fill support frame.

15. The method according to claim 11, further comprising the step of:

disposing an outer fill module of the fill modules into the fill frame support in an opening between a plurality of columns from within the rectilinear cooling tower.

16. The method according to claim 15, further comprising the step of:

disposing an inner fill module of the fill modules into the fill frame support to rest against the outer fill module.

* * * * *